US006697085B2

(12) United States Patent
Lai et al.

(10) Patent No.: US 6,697,085 B2
(45) Date of Patent: Feb. 24, 2004

(54) METHOD AND APPARATUS FOR REDUCING DYNAMIC FALSE CONTOUR IN PLASMA DISPLAY PANEL BY DECREASING VISUAL CONCENTRATION DIFFERENCE

(75) Inventors: Yao-Hung Lai, Taipei (TW); Chun-Hsu Lin, Taipei (TW); Liang-Kuei Hsu, Taipei (TW); Kuang-Lang Chen, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 182 days.

(21) Appl. No.: 09/983,454

(22) Filed: Oct. 24, 2001

(65) Prior Publication Data

US 2003/0076335 A1 Apr. 24, 2003

(51) Int. Cl.[7] ..... G09G 5/10
(52) U.S. Cl. ..... 345/690
(58) Field of Search ..... 345/37, 41, 60, 345/66, 589, 690, FOR 166; 348/29, 254, 671

(56) References Cited

PUBLICATIONS

Ho Seop Lee and Choon Woo Kim, A Look–Up Table Based Error Diffusion Algorithm for Dynamic False Contour Reduction of Plasma Display Panels, Journal of Information Display, vol. 2, No. 2, Jun. 2001 [online]. [retrieved on Jun. 18, 2003]. Retrievd from the —continuation—Internet: <URL: http://www.k–ids.or.kr/jid/paper/Jid_2–2/dsp–6–9.pdf.*

* cited by examiner

*Primary Examiner*—Matthew C. Bella
*Assistant Examiner*—G. F. Cunningham
(74) *Attorney, Agent, or Firm*—Bacon & Thomas, PLLC

(57) ABSTRACT

A method for reducing dynamic false contour in a plasma display panel (PDP) comprising the steps of selecting gray scales of different visual concentration series from all of gray scales available to be shown on said PDP to form a visual concentration conversion table, selecting at least one of said visual concentration series as a virtual visual concentration series, and converting original input value of gray scale of each discharge unit into corresponding gray scales of different visual concentration series and virtual visual concentration series, while showing each field of a dynamic image on said PDP, in order to average visual concentration difference between gray scales of two adjacent discharge units on the dynamic field into a smaller one.

5 Claims, 8 Drawing Sheets

METHOD AND APPARATUS FOR REDUCING DYNAMIC FALSE CONTOUR IN PLASMA DISPLAY PANEL BY DECREASING VISUAL CONCENTRATION DIFFERENCE

FIELD OF THE INVENTION

The present invention relates to plasma display panels (PDPS) and more particularly to a method and apparatus for reducing dynamic false contour in PDP by decrease visual concentration difference.

BACKGROUND OF THE INVENTION

Conventionally, an image shown on PDP is generated by a control circuit which is enabled to control the number of sustain pulses of red (R), green (G), blue (B) discharge cells of each constituent pixel of PDP based on image data. Hence, gray scale of image may be shown in pixel. This means that color of each pixel is a mixture of brightness and associated color continuously generated by cells. Hereinbelow throughout the specification an image shown on PDP is defined as a field. In general, a continuous sustain pulse of a field on typical PDP is distributed to several sub-fields as shown in FIG. 1. The number of sustain pulses of one sub-field is different from that of the other. In showing a field on PDP, value of gray scale represented by each discharge cell is a combination of gray scales of all constituent sub-fields based on data of image to be shown. Thereafter, a complete field is formed by the sub-fields, thereby showing a desired gray scale. This is the principle of PDP displaying.

On PDP, in showing a field, value of gray scale represented by each cell is depending on data of image to be displayed. Based on rules shown in FIG. 1, it is possible of defining the number of sustain pulses of one sub-field corresponding to discharge cell. Hence, within a unit time required for showing a field in PDP, discharge cell of each sub-field may discharge based on the following typical parameters and weight of the number of sustain pulses thereof:

SF0:SF1:SF2:SF3:SF4:SF5:SF6:SF7=1:2:4:8:16:32:64:128

However, frequently there is a contour phenomenon caused by interlaced gray scales on portions of image while dynamically showing image on the typical PDP. Such phenomenon is called dynamic false contour. As understood that dynamic false contour may greatly reduce quality of image shown on PDP. Referring to FIG. 2, two continuous dynamic images are exemplified to discuss dynamic false contour wherein two adjacent cells have gray scales of 127 and 128 respectively. In detail, PDP utilize a time division technique to control number of sustain pulses of each cell for showing various gray scales (FIG. 1). Also, eyes of viewer may move as image moves. Hence, a trace of the dynamic image is generated on each point of retina. As a result, each point on retina may track image having different gray scales (FIG. 2). Referring to FIG. 3, hence when viewer watches two continuous dynamic scenes having gray scales of 127 and 128 on two adjacent cells respectively, gray scale of 127 will be sensed by R0 and R1 points of retina with respect to one cell, gray scale of 128 will be sensed by R3 and R4 points of retina with respect to the other cell, and gray scale of 0 will be sensed by R2 point of retina with respect to both cells (i.e., no gray scale) respectively. It is seen that there is a significant drop of sensed gray scale from R1 to R2 and from R2 to R3 with respect to scene represented by two adjacent cells respectively. For image sensed by eyes, interlaced gray scales (i.e., intermittent contour) occur on border between two adjacent cells having gray scales 127 and 128 respectively. This is so-called dynamic false contour.

For further explaining dynamic false contour a coefficient of visual concentration is defined below by PDP designers and manufacturers:

$$\text{coefficient of visual concentration}=(t1m1+t2m2+t3m3+\ldots)/(m1+m2+m3),$$

where m1, m2, m3, . . . are weights of sub-fields and t1, t2, t3, . . . are time from beginning to midpoint during sustain period in each sub-field. This is best illustrated in FIG. 4. In view of above calculated coefficient, it is found that when visual concentrations of gray scales of two adjacent cells are proximate dynamic false contour does not tend to occur. Hence, by analyzing coefficient of visual concentration between two adjacent cells on PDP those skilled in the art may employ a suitable technique to solve the dynamic false contour based on variation therebetween. In the disclosure of Japanese Patent Laid-open Publication No. 8-270,869, two sets of different coefficients of visual concentration are utilized to exhibit gray scale of each gray scale on PDP by a following technique wherein parameters and corresponding number of continuous sustain pulses are defined with respect to each cell:

SF0:SF1:SF2:SF3:SF4:SF5:SF6:SF7=1:2:4:8:16:24:32:40

Hence, on PDP as for two sets of coefficient of visual concentration gray scale of 39 is exhibited, i.e.:

1+2+4+8+24=39;

and

1+2+4+32=39

Similarly, as for three sets of coefficient of visual concentration gray scale of 40 is exhibited, i.e.:

8+32=40;

16+24=40;

and

40=40

In view of above patent, gray scale exhibited on PDP may be one of multiple sets of coefficient of visual concentration having different combinations as shown in FIG. 5. For solving dynamic false contour it is possible of dividing gray scales having different combinations into two sets of gray scale having different coefficients of visual concentration (e.g., A and B series) based on visual concentration. Further, an average value is obtained from visual concentrations of the sets of gray scale. The average value is taken as a parameter for solving dynamic false contour. As a result, visual concentration difference of gray scale between two adjacent cells is reduced. Referring to FIG. 6, adjacent pixels can exhibit gray scales having sets of different coefficients of visual concentration on PDP as disclosed by the above patent. As a result, visual concentration is more average for substantially eliminating dynamic false contour. In brief, such technique may smooth visual concentration and generate less obvious dynamic false contour. However, as understood that various gray scales exhibited by cells of PDP are determined by the number of discharge. Hence, it is disadvantageous for the discharge of PDP by utilizing two sets of gray scale having different coefficients of visual concentration to exhibit gray scale on each cell.

Thus, it is desirable to provide a method and apparatus for reducing dynamic false contour in PDP by decreasing visual concentration difference in order to overcome the above drawbacks of prior art.

SUMMARY OF THE INVENTION

It is therefore an object of the present invention to provide a method for reducing dynamic false contour in a plasma display panel (PDP) comprising the steps of selecting gray scales of different visual concentration series from all of gray scales available to be shown on said PDP to form a visual concentration conversion table, selecting at least one of said visual concentration series as a virtual visual concentration series, converting the original input value of gray scale of each discharge unit into corresponding gray scales of different visual concentration series and virtual visual concentration series while showing each field of a dynamic image on said PDP, showing said converted gray scales on corresponding discharge units corresponding to each sub-field of each field, wherein said gray scales are selected to show the same value of gray scale based on the number of sustain pulses corresponding to values of gray scales of different visual concentration series and virtual visual concentration series.

In one aspect of the present invention, visual concentration of different value of gray scale shown by any two adjacent discharge units on the dynamic field is averaged to obtain a value of gray scale having a smaller visual concentration difference. This can substantially eliminate dynamic false contour on PDP due to larger visual concentration difference.

The above and other objects, features and advantages of the present invention will become apparent from the following detailed description taken with the accompanying drawings.

DETAILED DESCRIPTION OF THE PREFERRED EMBODIMENTS

Typically, eyes of human being cannot distinguish variation of gray scale of discharge units (i.e. cells or pixels) of PDP as watching dynamic scenes on PDP. This is because a series of gray scales exhibited by units of PDP has been combined to form an image having brightness and color acceptable to eyes while watching.

Moreover, in showing a field on PDP, discharge unit corresponding to each sub-field of field shows a predetermined value of gray scale based on the defined number of sustain pulses. Also, value of gray scale may have more than one visual concentration series depending on different number of sustain pulses of discharge unit corresponding to each sub-field. Hence, in showing a value of gray scale on a dynamic field of PDP, the same values of gray scale of different visual concentration series are shown on the continuously changed field. As a result, values of gray scale of each field are not adversely affected. By utilizing this principle, the invention employs a visual concentration conversion table on PDP for converting input values of gray scale of each discharge unit into different visual concentration series. Next, selects at least one visual concentration series as a virtual visual concentration series. Hence, in dynamically showing an image, each discharge unit may sequentially show the same value of gray scale based on different visual concentration series and virtual visual concentration series corresponding to the value of gray scale. Further, with the addition of virtual visual concentration series, visual concentration of the shown same value of gray scale on each discharge unit may be averaged to obtain a desired value of visual concentration. In view of above, by utilizing the method of the invention when visual concentration difference of values of gray scale shown by two adjacent discharge units is too large (i.e., larger than a predetermined value), it is possible of causing each discharge unit to select suitable virtual visual concentration series from different visual concentration series corresponding to value of gray scale respectively. Thus, visual concentration of value of gray scale is averaged to obtain a visual concentration having a smaller difference. This can substantially eliminate dynamic false contour on PDP in showing dynamic image.

Figure 1:
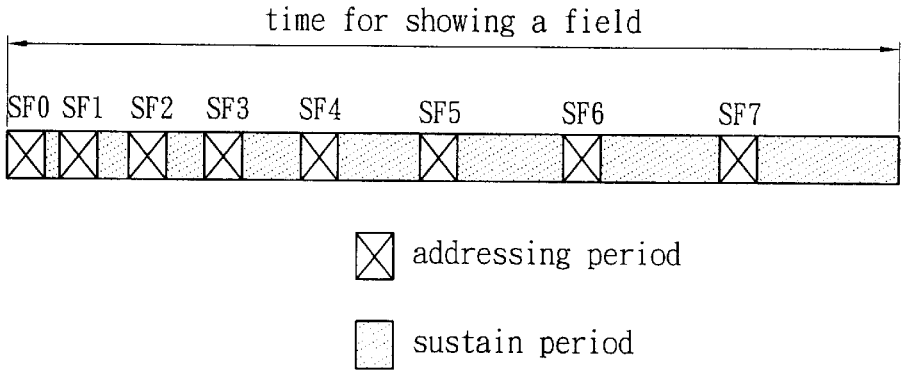
FIG. 1 (Prior Art)
FIG. 1 is a diagram showing a relationship of cells versus corresponding parameters during sustain period within a time span for showing a sub-field.
Figure 2:
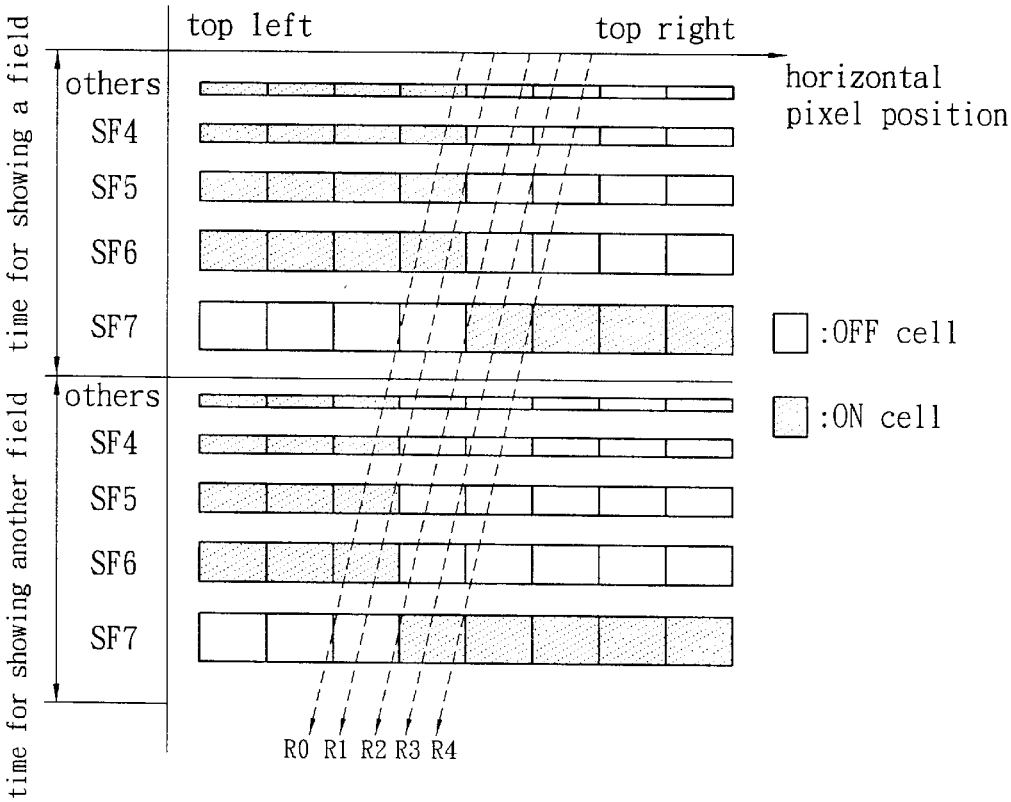
FIG. 2 (Prior Art)
FIG. 2 is a graph showing a trace generated on each point of retina versus gray scale exhibited on adjacent cells when eyes of viewer move as two continuous scenes move on a conventional PDP.
Figure 3:
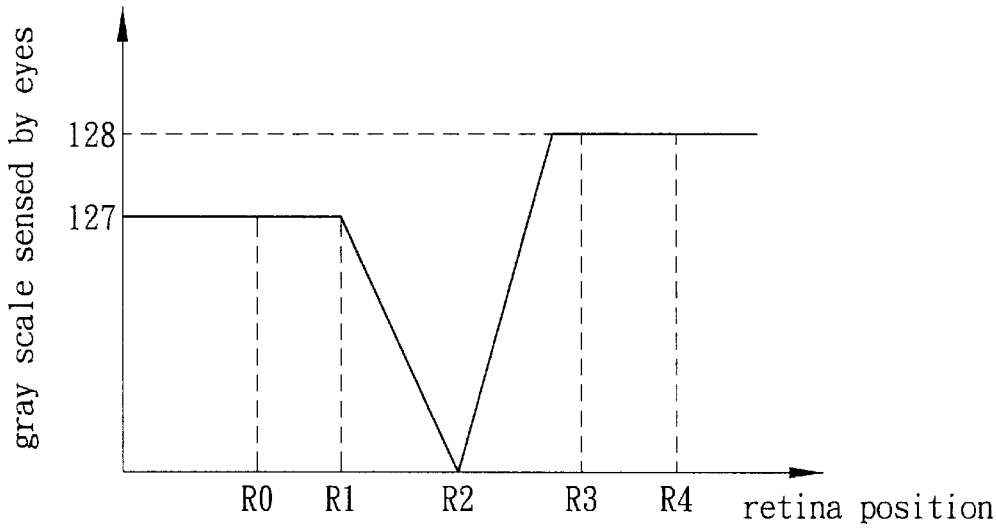
FIG. 3 (Prior Art)
FIG. 3 is a graph showing a relationship of sensed gray scales and points of retina with respect to the FIG. 2 image.
Figure 4:
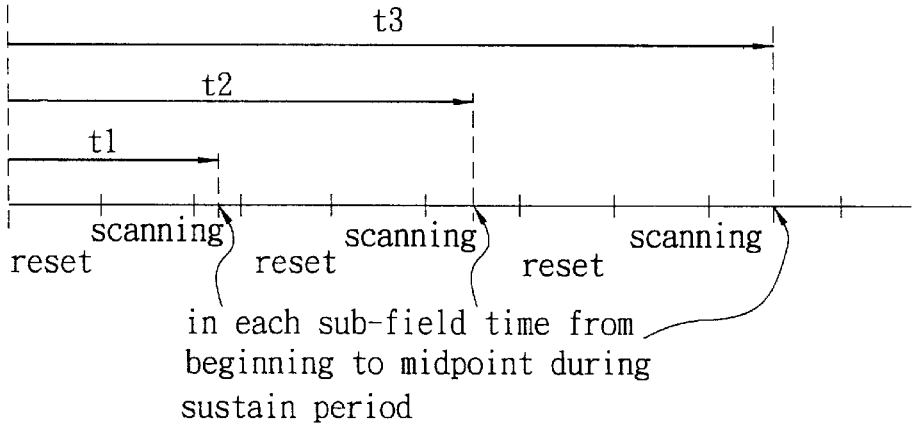
FIG. 4 (Prior Art)
FIG. 4 is a graph showing periods of time from beginning to midpoint during sustain period on different cells.
Figure 5:
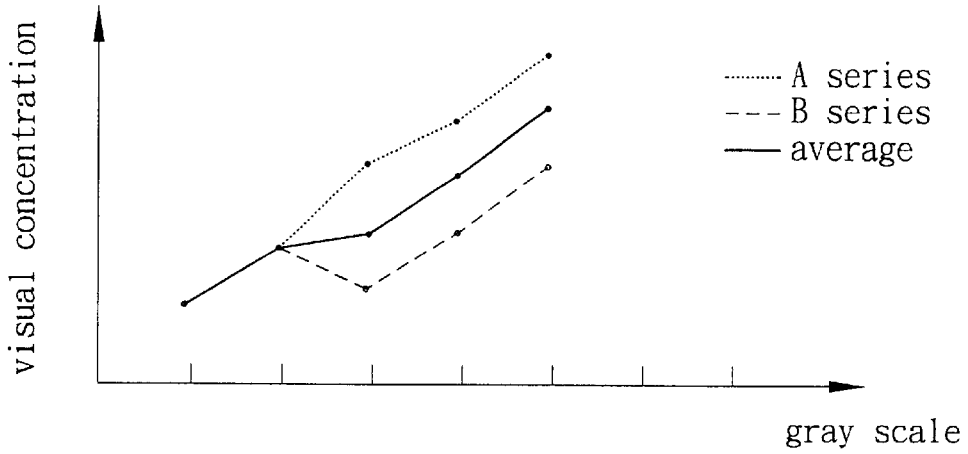
FIG. 5 (Prior Art)
FIG. 5 is a graph illustrating a technique disclosed by Japanese Patent Laid-open Publication No. 8-270,869 for adjusting visual concentration by utilizing two sets of different coefficients of visual concentration.
Figure 6:
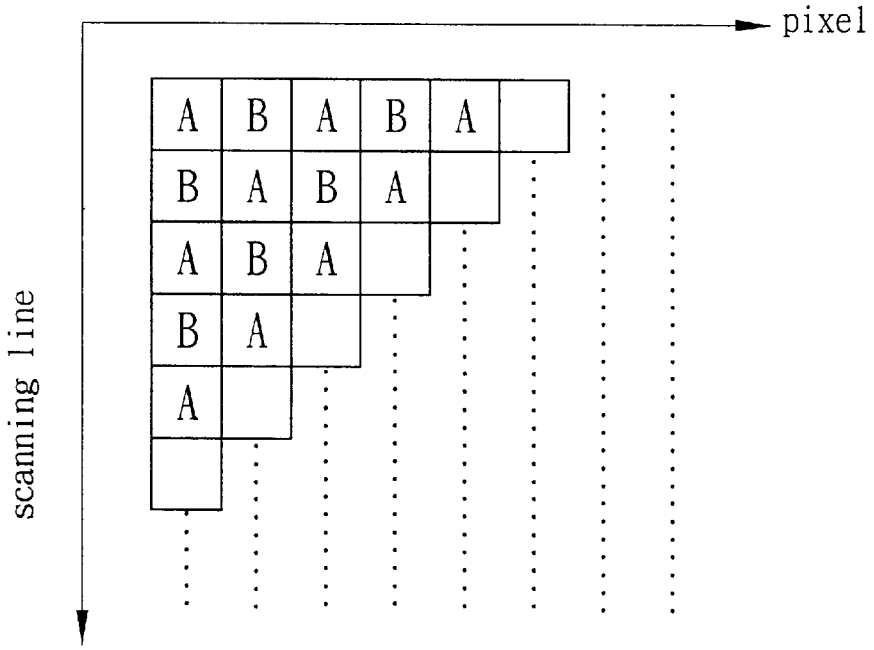
FIG. 6 (Prior Art)
FIG. 6 is a graph showing a distribution of adjacent pixels exhibited by gray scales having sets of different coefficients of visual concentration on PDP of the FIG. 5.
Figure 7:
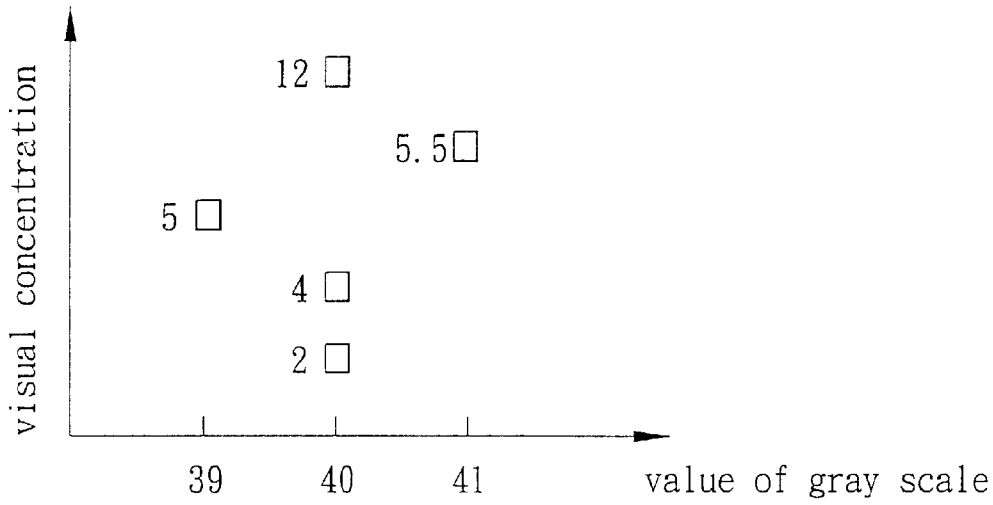
FIG. 7 is a graph illustrating a relationship of visual concentration and gray scale according to the invention.

Referring to FIG. 7, the invention will now be described. First, each discharge unit of PDP shows different values of gray scale (i.e., number of continuous sustain pulses). Further, an analysis is made on corresponding different visual concentration series and visual concentration difference between different visual concentration series of values of gray scale. As an end, it is possible of identifying potential dynamic false contour. In an example of the series having values of gray scale from 39 to 41, if the corresponding visual concentration of value of gray scale 39 is 5, visual concentrations corresponding to value of gray scale 40 are 2, 4, and 12 respectively, and visual concentration corresponding to value of gray scale 41 is 5.5. Then, when values of gray scale of two adjacent discharge units are 39 and 40 respectively, visual concentration difference therebetween falls into one of the following sets:

(1) 5 to 12,
(2) 5 to 4, and
(3) 5 to 2

Also, when values of gray scale of two adjacent discharge units are 40 and 41 respectively, visual concentration difference thereof falls into one of the following sets:

(1) 12 to 5.5,
(2) 4 to 5.5, and
(3) 2 to 5

In view of above, a significant visual concentration difference is generated because there is a difference between the visual concentration series of value of gray scale shown by two adjacent discharge units. Particularly, as visual concentration changes from 5 to 12, 5 to 2, 12 to 5.5, or 2 to 5, a potential dynamic false contour may be occurred.

Figure 8:
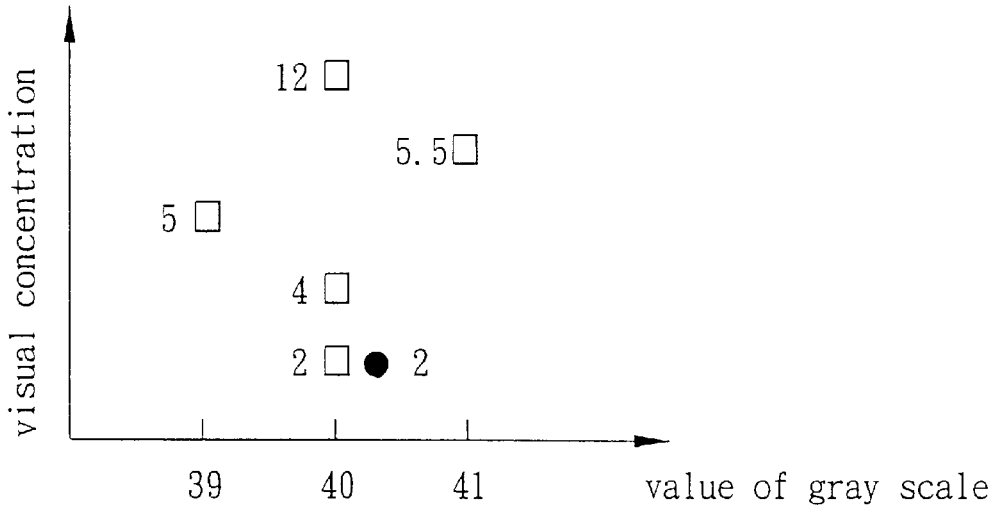
FIG. 8 is a graph similar to FIG. 8 where a virtual visual concentration is added.

Referring to FIG. 8, above analysis result is utilized by the invention. As shown, a visual concentration series C (e.g., the series having a visual concentration of 2) is selected from three different visual concentration series A, B and C (e.g., ones having visual concentrations of 2, 4 and 12 respectively) corresponding to value of gray scale of 40 as a virtual visual concentration series C'. Hence, in the process of showing a dynamic image, each discharge unit may show an image having value of gray scale of 40 based on different visual concentration series A, B, and C (e.g., ones having visual concentrations of 2, 4 and 12 respectively) and the virtual visual concentration series C' (e.g., one having visual concentration of 2). With the addition of virtual visual concentration series C', visual concentration of value of gray scale of 40 will be averaged with smaller visual concentration differences of adjacent discharge units (i.e., (12+4+2+2)/4=5) during display. This can substantially eliminate dynamic false contour on PDP in showing dynamic image.

Figure 9:
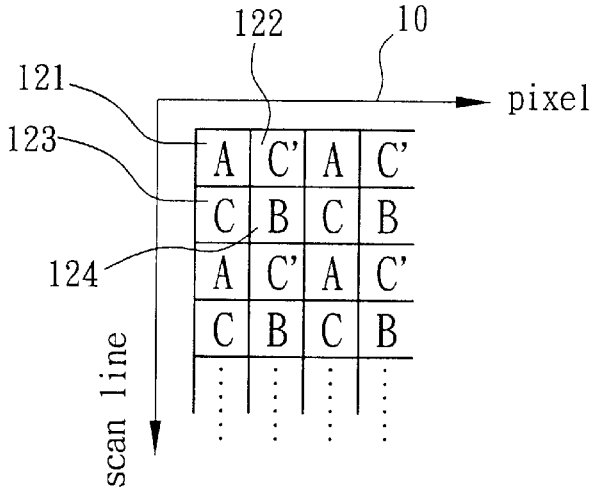
FIG. 9 is a graph showing distribution of different series of pixels on each pixel, where gray scales of three different visual concentration series and a virtual visual concentration series are used to adjust the whole visual concentration and discharge unit of a field is divided into odd number pixel series and even number pixel series according to a first preferred embodiment of the invention.

A first preferred embodiment of the invention as shown in FIG. 9, in showing dynamic image of continuous field on PDP 10 a plurality of adjacent discharge units 121, 122, 123 and 124 have the same value of gray scale. The input values of gray scale are converted into corresponding different visual concentration series A, B and C and virtual visual concentration series C' by visual concentration conversion table. In such a manner, in showing continuous field on PDP, the same values of gray scale are shown by adjacent discharge units 121, 122, 123 and 124. Since the same value of gray scale belongs to different visual concentration series and virtual visual concentration series the visual concentration of the whole will be averaged to obtain a desired value of visual concentration.

Figure 10:
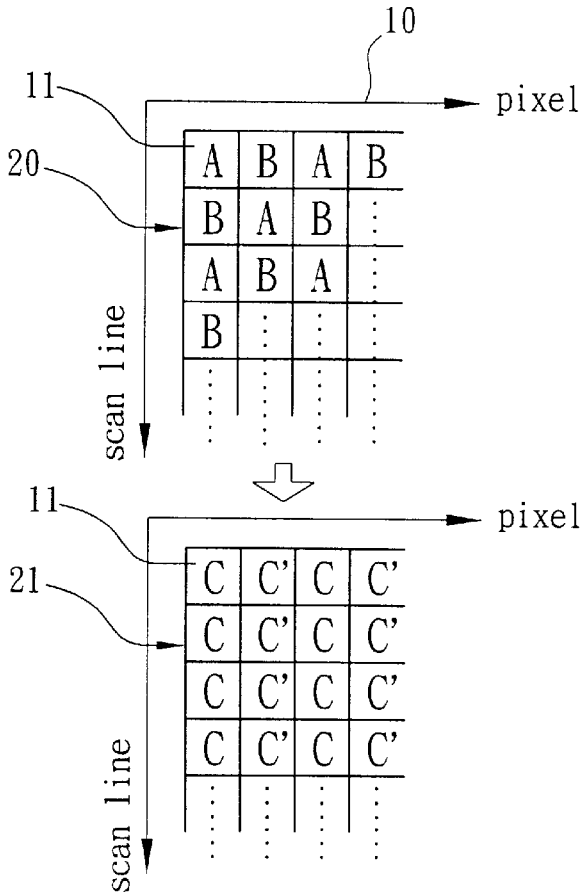
FIG. 10 is a graph showing distribution of different series of pixels on each pixel, where gray scales of two different visual concentration series are shown on adjacent discharge units of a field and gray scales of a different visual concentration series and virtual visual concentration series are shown on adjacent discharge units of another field so as to adjust the whole visual concentration according to a second preferred embodiment of the invention.

A second preferred embodiment of the invention as shown in FIG. 10, in showing dynamic image of two adjacent fields 20 and 21 on PDP 10 discharge units 11 have the same value of gray scale. The input values of gray scale are converted into corresponding different visual concentration series A, B and C and virtual visual concentration series C' all having the same value of gray scale by visual concentration conversion table. Also, in an alternate discharge unit 11 of alternate field 20, values of gray scale of different visual concentration series are shown. In an alternate discharge unit 11 of another field 21, values of gray scale of different visual concentration series C and virtual visual concentration series C' are shown. Hence, discharge unit 11 corresponding to field 20 or 21 may show the same gray scale based on values of gray scale and corresponding number of sustain pulses of different visual concentration series A, B, and C and virtual visual concentration series C'. Since the same value of gray scale belongs to different visual concentration series A, B and C and virtual visual concentration series C' the visual concentration of the whole will be averaged to obtain a desired value of visual concentration.

Figure 11:
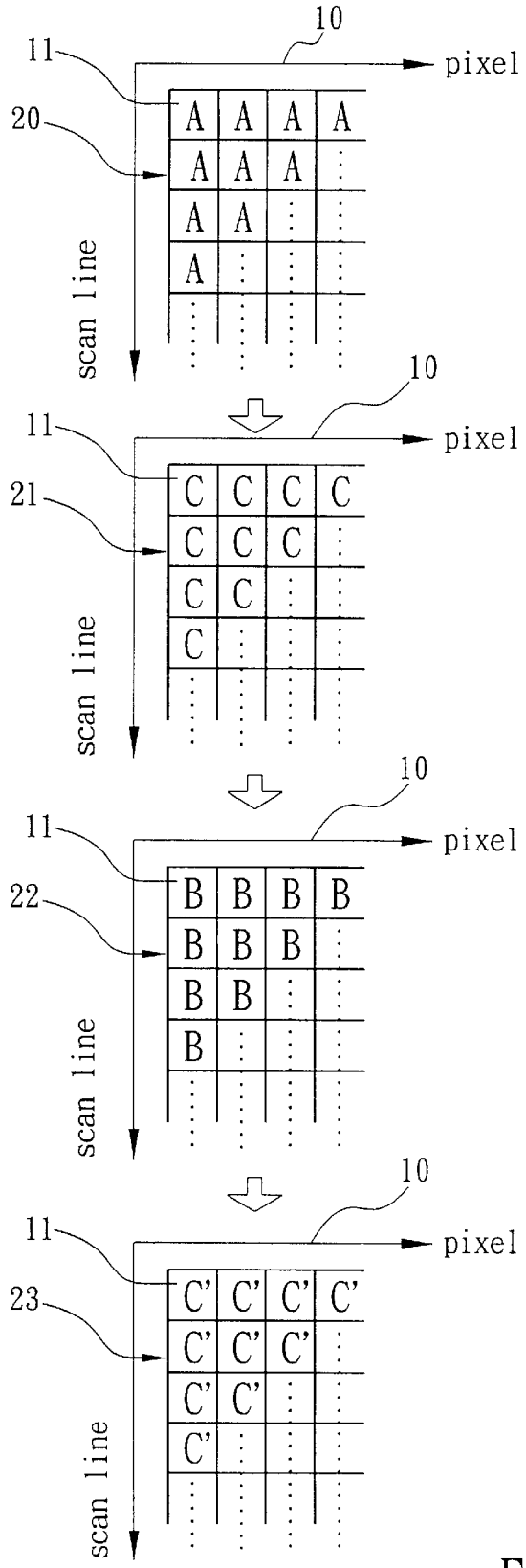
FIG. 11 is a graph showing distribution of different series of pixels on each pixel, where gray scales of three different visual concentration series and a virtual visual concentration series are shown on discharge units of field of adjacent series so as to adjust the whole visual concentration according to a third preferred embodiment of the invention.

A third preferred embodiment of the invention as shown in FIG. 11, in showing dynamic image of each of continuous fields 20, 21, 22, and 23 on PDP 10 each discharge unit 11 generates the same input value of gray scale corresponding to each of continuous fields 20, 21, 22, and 23. The input values of gray scale are converted into corresponding different visual concentration series A, B and C and virtual visual concentration series C' all having the same value of gray scale by visual concentration conversion table. Hence, discharge unit 11 corresponding to each sub-field of each of fields 20, 21, 22, and 23 may show the same gray scale based on values of gray scale and corresponding number of sustain pulses of different visual concentration series A, B, and C and virtual visual concentration series C'. Since the same value of gray scale belongs to different visual concentration series A, B and C and virtual visual concentration series C' the visual concentration of the whole will be averaged to obtain a desired value of visual concentration.

Figure 12:
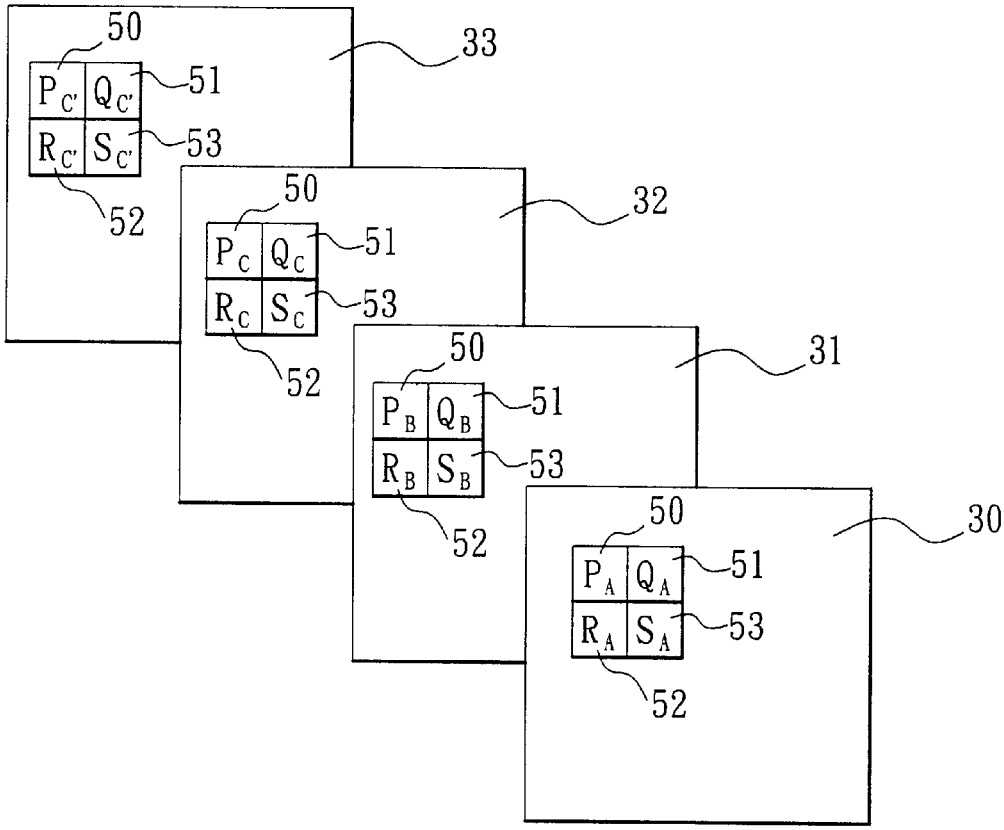
FIG. 12 is a graph showing distribution of values of gray scale, where in a continuous field values of gray scale of three different visual concentration series and a virtual visual concentration series are used to adjust the whole visual concentration according to the invention.

Referring to FIG. 12, in above preferred embodiments visual concentration difference among different values of gray scale P, Q, R and S shown by adjacent discharge units 50, 51, 52 and 53 on continuous fields 30, 31, 32 and 33 is too large (i.e., larger than a predetermined value). In response, in the process of showing each of the continuous dynamic fields 30, 31, 32 and 33 visual concentration conversion table is utilized to convert each of input values of gray scale P, Q, R and S into the same values of gray scale $P_A$, $P_B$, $P_C$, $P_{C'}$; $Q_A$, $Q_B$, $Q_C$, $Q_{C'}$; $R_A$, $R_B$, $R_C$, $R_{C'}$; and $S_A$, $S_B$, $S_C$, and $S_{C'}$ of different visual concentration series and virtual visual concentration series. Hence, in continuously showing each of fields 30, 31, 32 and 33 as to the different values of gray scale $P_A$, $P_B$, $P_C$, $P_{C'}$; $Q_A$, $Q_B$, $Q_C$, $Q_{C'}$; $R_A$, $R_B$, $R_C$, $R_{C'}$; and $S_A$, $S_B$, $S_C$, and $S_{C'}$ shown by adjacent discharge units 50, 51, 52 and 53, the visual concentration thereof can be averaged to obtain one having smaller visual concentration difference by virtual visual concentration series $P_{C'}$, $Q_{C'}$, $R_{C'}$, and $S_{C'}$. As such, it is possible of substantially eliminating dynamic false contour on PDP caused by undesired large visual concentration difference of values of gray scale P, Q, R and S of adjacent discharge units 50, 51, 52, and 53.

Figure 13:
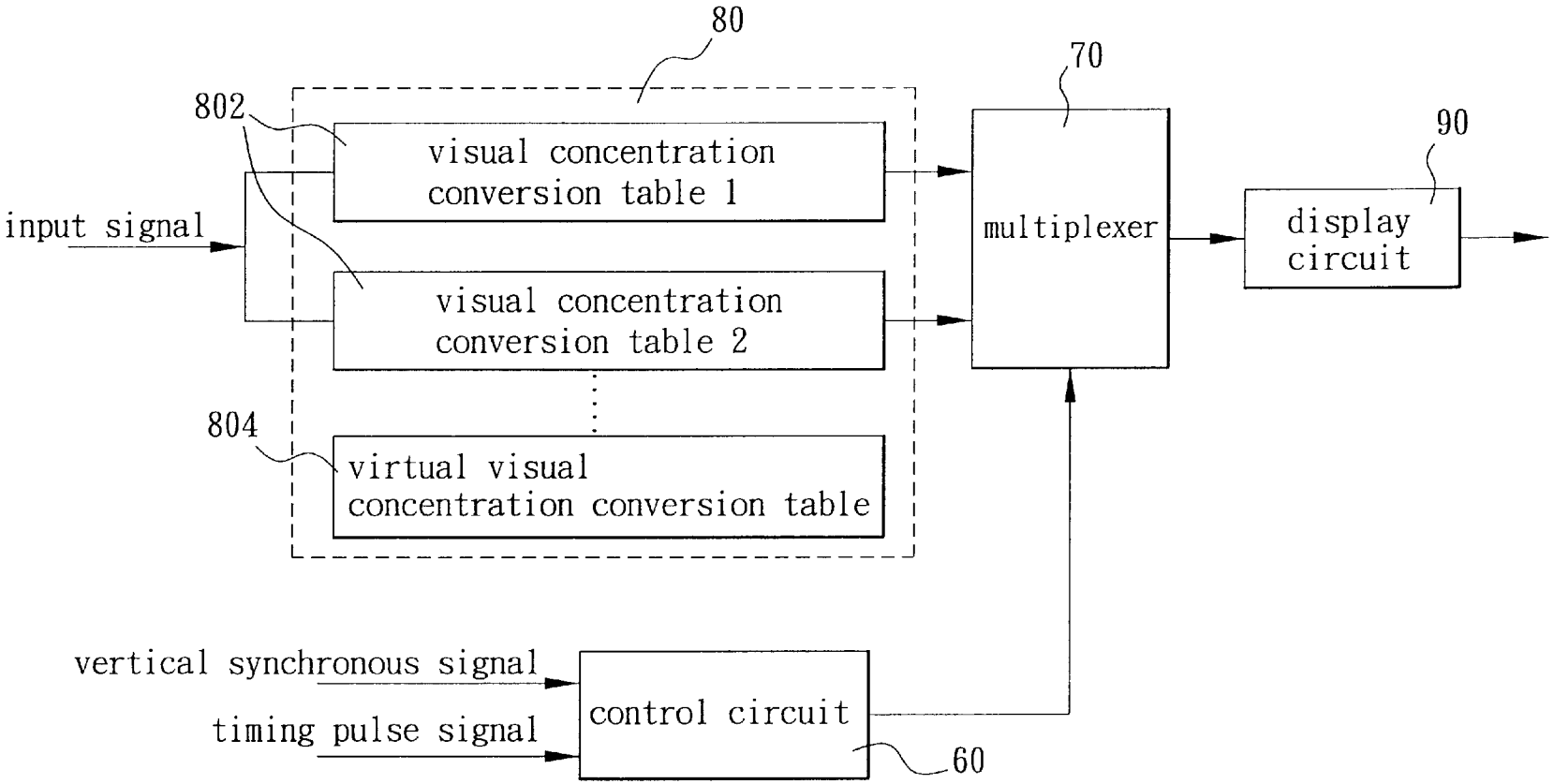
FIG. 13 is a block diagram showing electrical components according to above preferred embodiments of the invention.

For implementing above preferred embodiments, the invention use a multiplexer 70 as a data selector in showing dynamic image on PDP as shown in FIG. 13. The multiplexer 70 acts to determine the current output field based on vertical synchronous signals and timing pulse signals received by control circuit 60. The multiplexer 70 also selects a corresponding field from different visual concentration series 802 generated by visual concentration conversion table and multiple sets of input fields of a selected virtual visual concentration series 804. Next, the multiplexer 70 outputs the selected one to display circuit 90 for driving each of discharge units. Thereafter, fields are shown on PDP. As an end, in showing continuous field on PDP visual concentration of different values of gray scale shown by any two of adjacent discharge units can be averaged to obtain one having smaller visual concentration difference, resulting in a much elimination of the undesired dynamic false contour caused by large visual concentration difference.

While the invention has been described by means of specific embodiments, numerous modifications and variations could be made thereto by those skilled in the art without departing from the scope and spirit of the invention set forth in the claims.

What is claimed is:

1. A method for reducing dynamic false contour in a plasma display panel (PDP) comprising the steps of:

selecting some gray scales of different visual concentration series from all of gray scales available to be shown on said PDP to form a visual concentration conversion table, said visual concentration series corresponding to a coefficient of visual concentration defined as follows:

$$\text{coefficient of visual concentration}=(t1m1+t2m2+t3m3+\ldots)/(m1+m2+m3+\ldots),$$

where:

m1, m2, m3, . . . are weights of each sub-field of each field, and t1, t2, t3, . . . are times from a beginning to a midpoint during a sustain period of each sub-field;

selecting at least one of said visual concentration series as a virtual visual concentration series;

converting an original input value of a gray scale of each discharge unit into a corresponding said selected gray scales of different visual concentration series via said conversion table and corresponding gray scale of said virtual visual concentration series while showing each field of a dynamic image on said PDP; and showing said converted gray scales on corresponding said discharge units corresponding to each sub-field of each field;

wherein said gray scales are selected to show the same value of gray scale based on the number of sustain pulses corresponding to values of said gray scales of different visual concentration series and virtual visual concentration series.

2. The method of claim 1, wherein in showing the dynamic image of a continuous field on the PDP a plurality of the adjacent discharge units have the same value of gray scale so that the input values of gray scale are converted into different said visual concentration series and one of said virtual visual concentration series by the visual concentration conversion table, the same value of gray scale is shown on the adjacent discharge units by the different visual concentration series and the virtual visual concentration series, and a visual concentration of the discharge units is averaged to obtain a desired one since the same value of gray scale belongs to the different visual concentration series and the virtual visual concentration series.

3. The method of claim 1, wherein in showing the dynamic image of any two of the adjacent fields on the PDP the discharge units have the same value of gray scale so that the input values of gray scale are converted into different said visual concentration series and one of said virtual visual concentration series having the same value of gray scale are shown, and a visual concentration of the discharge units is averaged to obtain a desired one since the same value of gray scale belongs to the different visual concentration series and the virtual visual concentration series.

4. The method of claim 1, wherein in showing the dynamic image of each of the continuous fields on the PDP each discharge unit generates the same input value of gray scale corresponding to each of the continuous fields so that the input values of gray scale are converted into different said visual concentration series and one of said virtual visual concentration series all having the same value of gray scale by the visual concentration conversion table, each discharge unit corresponding to each sub-field of each field shows the same gray scale based on the values of gray scale and corresponding number of sustain pulses of the different said visual concentration series and one of said virtual visual concentration series, and a visual concentration of the discharge units is averaged to obtain a desired one since the same value of gray scale belongs to the different visual concentration series and the virtual visual concentration series.

5. An apparatus for reducing dynamic false contour in a plasma display panel (PDP) having a plurality of discharge units, the apparatus comprising:

a conversion circuit having a visual concentration conversion table so that the conversion circuit is operable to identify a value of gray scale of each discharge unit when said each discharge unit receives an input field signal, convert the value of gray scale of each discharge unit into a plurality of sets of different visual concentration series and at least one set of a virtual visual concentration series all having the same value of gray scale by the visual concentration conversion table, said visual concentration series corresponding to a coefficient of visual concentration defined as follows:

$$\text{coefficient of visual concentration}=(t1m1+t2m2+t3m3+\ldots)/m1+m2+m3),$$

where:

m1, m2, m3, . . . are weights of sub-fields, and t1, t2, t3, . . . are times from a beginning to a midpoint during a sustain period of each sub-field;

a control circuit for receiving vertical synchronous signals and timing pulse signals, and a multiplexer being operable to determine a current output field based on the signals sent from the control circuit, selecting a corresponding field from a plurality of sets of input fields generated by the conversion circuit, and output the selected field to a display circuit for driving each discharge unit, whereby when the fields are continuously shown on the PDP a visual concentration of different values of gray scale shown by an two of the adjacent discharge units is averaged to obtain ones having a smaller visual concentration difference.

* * * * *